United States Patent [19]

Epp

[11] Patent Number: 4,856,663

[45] Date of Patent: Aug. 15, 1989

[54] NURSING DEVICE FOR INFANT WITH CLEFT LIP OR CLEFT PALATE

[76] Inventor: Lyda Epp, 29533 Tulare Ave., Shafter, Calif. 93263

[21] Appl. No.: 183,109

[22] Filed: Apr. 19, 1988

[51] Int. Cl.[4] ..... A61J 11/04; A61J 13/00; A61J 17/00

[52] U.S. Cl. ..... 215/11.1; 128/360

[58] Field of Search ..... 215/11.1–11.6; 128/360

[56] References Cited

U.S. PATENT DOCUMENTS

| | | | |
|---|---|---|---|
| 77,393 | 4/1868 | Laughlin | 128/150 |
| 751,415 | 2/1904 | Prindle | 128/150 |
| 1,012,980 | 12/1911 | Brophy | 215/11.1 |
| 1,032,518 | 7/1912 | Thieringer | 128/150 |
| 1,207,120 | 12/1916 | Younker | 215/11.1 |
| 2,364,866 | 12/1944 | Meynier | 128/150 |
| 2,816,547 | 12/1957 | Adisman | 215/11.1 |
| 3,669,112 | 6/1972 | Mager et al. | 215/11.1 X |
| 4,632,263 | 12/1986 | Gertzman | 215/11.1 |

FOREIGN PATENT DOCUMENTS

| | | | |
|---|---|---|---|
| 1385450 | 12/1964 | France | 215/11.1 |

OTHER PUBLICATIONS

Razek, "Prosthetic Feeding Aids for Infants with Cleft Lip and Palate", The Journal of Prosthetic Dentistry, vol. 44, No. 5, Nov. 1980, pp. 556–561.

Grady, "Breast Feeding the Baby with a Cleft of the Soft Palate", Clinical Pediatrics, vol. 16, No. 11, pp. 978–981, Nov. 1977.

Hemingway, "Breast Feeding a Cleft-Palate Baby", The Medical Journal of Australia, 9/9/1972, p. 626.

Martin, "A New 'Gravity Flow' Nipple for Feeding Infants with Congenital Cleft Palate", Pediatrics, vol. 72, No. 2, Aug. 1983, p. 244.

Pashayan et al, "Simplified Method of Feeding Infants Born with Cleft Palate With or Without Cleft Lip", American Journal of Disabled Children, vol. 133, 2/1979.

Styer et al, "Feeding Infants with Cleft Lip and/or Palate", JOGN Nursing, vol. 10, No. 5, Sep./Oct. 1981, pp. 329–332.

Russell et al, "Cleft Lip and Cleft Palate", Ross Laboratories Clinical Education Aid No. 11, Teaching Reference 6185, Jun. 1977.

Balluff et al, "Using a Feeding Appliance to Aid the Infant with a Cleft Palate", Ear, Nose and Throat Journal, vol. 65, 7/1986, pp. 50/316–50/320.

Dunning, "Feeding Babies with Cleft Lip and Palate", Nursing Times, Jan. 29, 1986, pp. 46–47.

Pielou et al, "A Modified Feeding Plate for Use in Cleft Palate Infants", Journal of Paediatric Dentistry (1985) I, pp. 61–64.

Advertisement of Playskool for Nipples (date unknown).

Clarren, et al., *Feeding Infants with Cleft Lip, Cleft Palate, or Cleft Lip and Cleft Palate,* Cleft Palate Journal, 7/87.

Paradise, et al., *Feeding Infants with Cleft Palate,* Pediatrics, vol. 74, No. 2, Aug. 1984, p. 316.

Rutrick, et al., *Bilateral Cleft Lip and Palate: Pre-Surgical Treatment,* Annals of Plastic Surgery, vol. 12, No. 2, Feb. '84, pp. 105–116.

*Primary Examiner*—Sue A. Weaver

*Attorney, Agent, or Firm*—Jerry N. Lulejian

[57] ABSTRACT

In connection with a child with a cleft palate and/or cleft lip, a device to allow the child to effectively suck by mouth typically comprising a solid duckbill shaped shield with an incorporated nipple on its underside together with a means of interconnecting the nipple to a baby bottle or the breast. The shield acts to seal the cleft palate while keeping the nipple from collapsing into the cleft palate and cleft lip to allow the infant to suck liquids from a bottle or the breast.

2 Claims, 2 Drawing Sheets

NURSING DEVICE FOR INFANT WITH CLEFT LIP OR CLEFT PALATE

BACKGROUND OF THE INVENTION

The present invention relates to an apparatus for feeding infants with cleft palate and/or cleft lip.

The present invention has solved a long standing problem of feeding infants with cleft lip and/or cleft palate. Specifically, cleft lip and/or cleft palate is the second most common birth defect and occurs approximately in one out of 700–800 live births in the United States. There are three types of cleft lip. These are the unilateral incomplete, the unilateral complete and the bilateral complete. The cleft palate comes in three versions, the soft palate only, the unilateral complete and the bilateral complete. However, each of the cleft lip and/or cleft palate malformations involve a leakage of air from the mouth through the nose which causes the infant to be unable to suck, causes regurgitation of fluids through the nose and involves difficulty in swallowing and breathing.

Until the cleft lip and/or cleft palate can be surgically corrected (generally six months after birth) the infant must be adequately fed until he is strong enough and has matured enough for the plastic surgery that can correct the problem. Feeding is not only the most immediate problem encountered in the daily care of an infant with a cleft lip and/or cleft palate, but it is the most difficult to solve and the most necessary for the survival and thriving of the infant.

Several devices and methods have been tried to allow the infant to take nourishment. First, the prior art has produced a feeding plate which fits into the palate and seals off the cleft in both the lip and the palate to enable the infant to generate intraoral negative pressure to pull nourishment from conventional bottle nipples or from the breast. Of course, negative intraoral pressure (vacuum caused by sucking) is accomplished by sealing the lips and the velopharynx and expanding the intraoral cavity, either through contraction of the tongue or by movement of the mandible. The feeding plate is not without its problems. Specifically, the plate must be custom-made for the infant, is uncomfortable to the infant, will become obsolete as the infant grows, may be partially swallowed by the infant, has a tendency to irritate the palate and lip of the child and does not allow the infant the natural feel of the nipple.

Next, the prior art has taught to use long and thin nipples on a bottle with the nipple placed in the back of the infant's mouth. The milk is then injected into the infant's throat so that he may swallow the milk without sucking. This method is an attempt to bypass the problem of the infant's inability to suck and does not allow for breast feeding of the infant, causes frequent choking and aspiration and prevents the child from experiencing the normal sucking instinct and developing the muscles of the mouth which are believed to aid in language articulation in later life.

Next, the prior art has taught to use wide nipples such as lambs' nipples which by their nature attempt to fill in the cleft palate in order to increase the intraoral negative pressure that the infant can generate. However, these nipples often collapse into the cleft palate and/or cleft lip cutting off the flow of milk to the infant and they are substantially ineffective in significantly increasing the ability to generate intraoral negative pressure.

The prior art has also taught miscellaneous methods such as squirting milk either from the breast or the bottle into side of the mouth of the infant as well as the use of naso-gastric or oro-gastric tubes to inject the nutrients directly into the infant's stomach.

The problems with the prior art's attempted solutions to the problem of feeding the infant with a cleft palate and/or cleft lip are that they either bypass the problem of the infant not being able to suck the nutrients from the bottle or breast or they provide incomplete or marginally effective methods of allowing the infant to take nourishment by sucking. The prior art methods and devices which attempt to increase the intraoral negative pressure have several disadvantages. Specifically, the infant is prevented from experiencing the natural sucking instinct, is prevented from developing the muscles of the face and mouth which are responsible for developing proper articulation in later life, is subject to regurgitation of milk through the nose as well as choking and aspiration on the milk and is subject to becoming irritable due to the extremely long amount of time necessary to consume small amounts of nutrients.

The present invention was created in response to the specific problem with the oversize nipples that have been used in the past in an attempt to effectively feed the infant with a cleft lip and/or cleft palate. The problem with these nipples again is that they often collapse within the cleft palate and/or cleft lip, cutting off the flow of milk. The present invention has solved this problem and allowed virtually any infant with cleft palate and/or cleft lip to effectively nurse either from the bottle or the breast.

SUMMARY OF THE INVENTION

In connection with a child with a cleft palate and/or cleft lip, the present invention is a device to allow the child to effectively suck by mouth comprising (1) a sealing means for sealably closing the cleft in the child's palate and (2) a nipple merged with the sealing means. The sealing means substantially prevents the nipple from being pulled into the cleft palate and cleft lip.

The device typically comprises a substantially solid, duck bill shaped, resilient shield having an upper surface and a lower surface with the nipple partially formed from the lower surface of the shield. The upper surface of the shield is installed in sealing relationship to the cleft palate.

The device may also have a means for interconnecting the nipple and shield to a container of liquid for conducting liquids from the container and through the nipple in response to the child sucking on the nipple.

The device may al so have a means for interconnecting the nipple and shield to the human breast for purposes of conducting liquids from the breast and through the nipple in response to the child sucking on the nipple.

The device may also include a means for interconnecting the nipple and shield to a plug to form a pacifier.

DETAILED DESCRIPTION OF THE INVENTION

Figure 1:
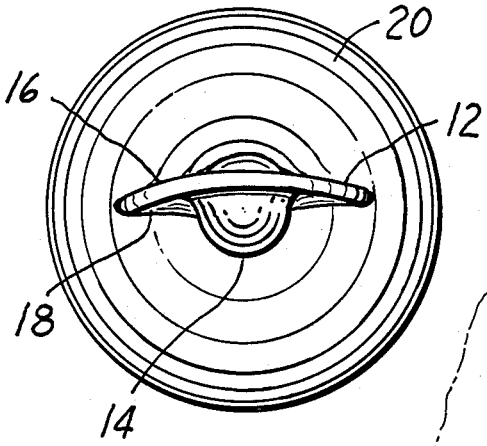
FIG. 1 is a front elevational view of the present invention which interfits on the human breast.

The present invention relates to an apparatus for feeding infants with cleft palate and/or cleft lip.

There has been a long standing problem of feeding infants with cleft lip and/or cleft palate until they are mature enough to have the problem corrected by plastic surgery. Since a cleft lip and/or cleft palate involves an opening between the mouth and the nose, the infant with one or more of these malformations is unable to take nourishment by sucking through the mouth as normal infants can. Of course, negative intraoral pressure (vacuum caused by sucking) is accomplished by sealing the lips and the velopharynx and expanding the intraoral cavity, either through contraction of the tongue or by movement of the mandible. The problem is magnified by the fact that cleft lip and/or cleft palate is the second most common birth defect and occurs approximately in one out of 700–800 live births in the United States.

There are three types of cleft lip. These are the unilateral incomplete, the unilateral complete and the bilateral complete. The cleft palate comes in three versions, the soft palate only, the unilateral complete and the bilateral complete. However, each of the cleft lip and/or cleft palate malformations involve a leakage of air from the mouth through the nose which causes the infant to be unable to suck, causes regurgitation of fluids through the nose and involves difficulty in swallowing and breathing.

Until the cleft lip and/or cleft palate can be surgically corrected (generally six months after birth) the infant must be adequately fed until he is strong enough and has matured enough for the plastic surgery that can correct the problem. Feeding is not only the most immediate problem encountered in the daily care of an infant with a cleft lip and/or cleft palate, but it is the most difficult to solve and the most necessary for the survival and thriving of the infant.

Several devices and methods have been tried to allow the infant to take nourishment. A feeding plate which fits into the palate and seals off the cleft in both the lip and the palate has been used to enable the infant to generate intraoral negative pressure to pull nourishment from conventional bottle nipples or from the breast. The feeding plate is not without its problems. Specifically, the plate must be custom-made for the infant, is uncomfortable to the infant, will become obsolete as the infant grows, may be partially swallowed by the infant, has a tendency to irritate the palate and lip of the child and does not allow the infant the natural feel of the nipple.

Next, the prior art has taught to use long and thin nipples on a bottle with the nipple placed in the back of the infant's mouth. The milk is then injected into the infant's throat so that he may swallow the milk without sucking. This method is an attempt to bypass the problem of the infant's inability to suck and does not allow for breast feeding of the infant, causes frequent choking and aspiration and prevents the child from experiencing the normal sucking instinct and developing the muscles of the mouth which are believed to aid in language articulation in later life.

Next, the prior art has taught to use wide nipples such as lambs' nipples which by their nature attempt to fill in the cleft palate in order to increase the intraoral negative pressure that the infant can generate. However, these nipples often collapse into the cleft palate and/or cleft lip cutting off the flow of milk to the infant and they are substantially ineffective in significantly increasing the ability to generate intraoral negative pressure.

The prior art has also taught miscellaneous methods such as squirting milk either from the breast or the bottle into side of the mouth of the infant as well as the use of naso-gastric or oro-gastric tubes to inject the nutrients directly into the infant's stomach.

The problems with the prior art attempts to solve this problem are that they either bypass the problem of the infant not being able to suck the nutrients from the bottle or breast or they provide at best incomplete or marginally effective methods of allowing the infant to nurse. The attempts have the disadvantages of preventing the infant from experiencing the natural nursing instinct, allowing the regurgitation of milk through the nose along with choking and aspiration on the milk while contributing to the irritability of the infant due to the extremely long amount of time and effort necessary to consume small amounts of nutrients.

The present invention was created in response to the specific problem with the oversize nipples that have been used in the past in an attempt to effectively feed the infant with a cleft lip and/or cleft palate. The problem with these nipples again is that they often collapse within the cleft palate and/or cleft lip, cutting off the flow of milk and they do not significantly increase the intraoral negative pressure that the infant can develop. The present invention has solved this problem and allowed virtually any infant with cleft palate and/or cleft lip to effectively nurse either from the bottle or the breast.

Figure 2:
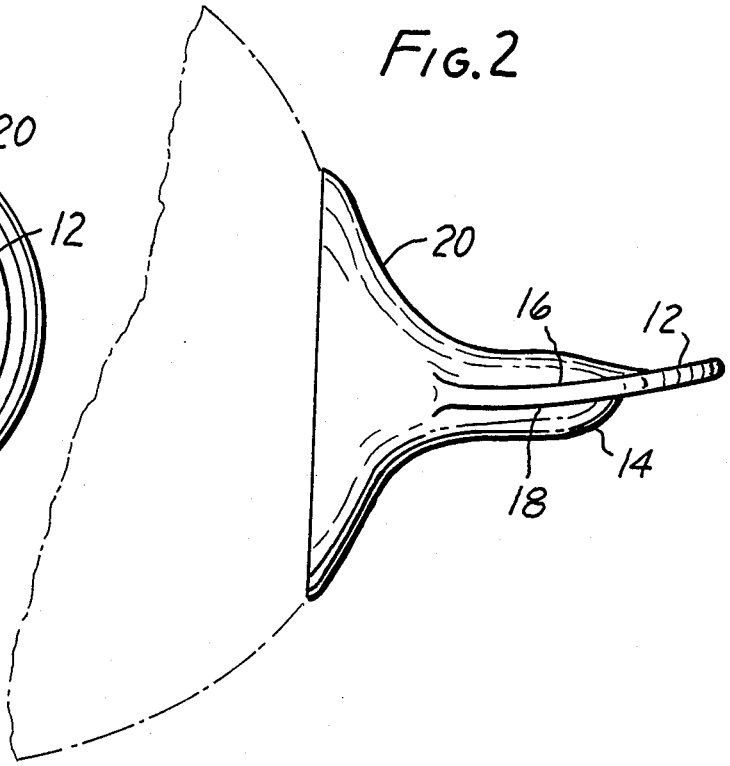
FIG. 2 is a side elevational view of the present invention which interfits to the human breast.

Referring specifically to FIGS. 1 and 2, a front elevational view and a side elevational view of the present invention specifically adapted for use with the human breast is shown. The shield 12 has an upper side 16 and a lower side 18. The lower side 18 of the shield 12 constitutes one of the walls of the nipple 14. The nipple 14 and shield 12 also form a suction cup section 20 which interfits over the human breast to allow the infant to take breast milk into his mouth by the creation of negative intraoral pressure.

The shield 12 is substantially solid and composed of a resilient material. In fact, the shield 12, the nipple 14 and the suction cup section 20 are all preferably formed of latex rubber with the shield 12 being substantially solid latex rubber at least along the portion of the shield 12 which forms one of the walls of the nipple 14. This is to enable the shield 12 to protect the nipple 14 against becoming collapsed into the cleft palate or cleft lip of the infant.

Figure 3:
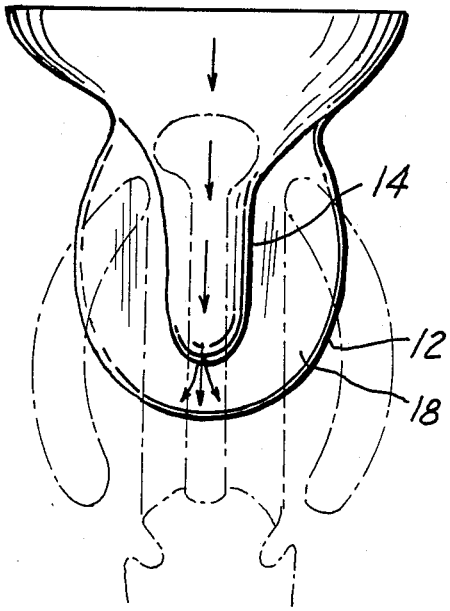
FIG. 3 is a bottom view of the present invention inserted into the mouth of an infant who has a bilateral complete cleft palate.

Referring specifically to FIG. 3, a typical bilateral complete cleft palate is shown with the shield 12 and incorporated nipple 14 inserted in the infant's mouth. The sealing of the bilateral complete cleft palate is shown together with the flow of milk (shown by arrows) through the nipple by the creation of negative intraoral pressure from the infant.

Figure 4:
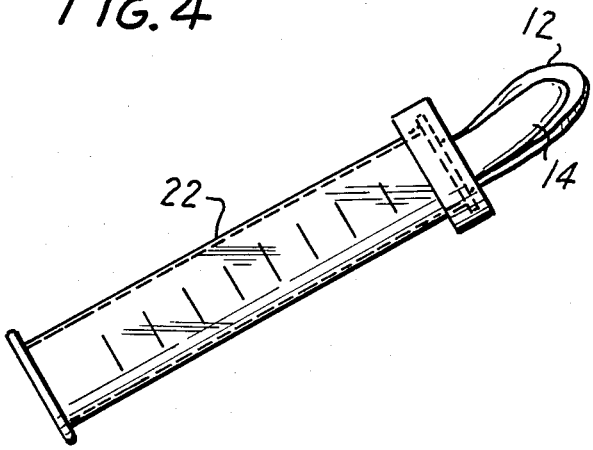
FIG. 4 is a side elevational view of the present invention interconnected to a bottle.
Figure 5:
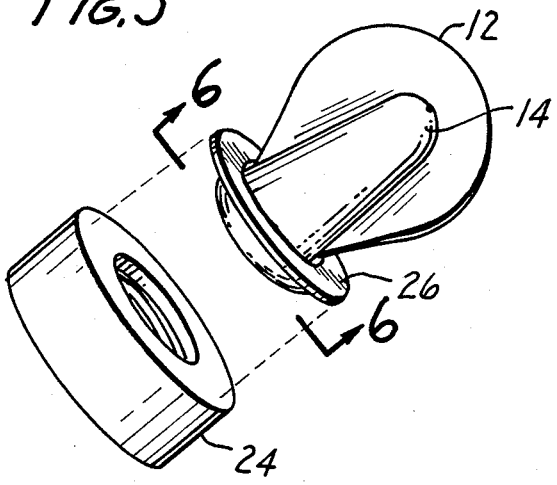
FIG. 5 is a perspective view of the embodiment of the present invention which interfits to a bottle showing the present invention and the fitted cap for interconnecting to the bottle.
Figure 6:
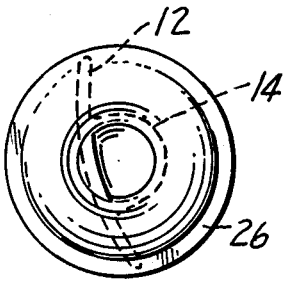
FIG. 6 is an elevational view along line 6—6 showing the circular lip and incorporated nipple of the present invention.

Referring specifically to FIGS. 4, 5 and 6, the shield 12 and incorporated nipple 14 are shown interconnected to a bottle 22 via a threaded bottle cap 24 and a circular lip section 26 for allowing the infant to pull liquid from the bottle 22 as opposed to the breast. The bottle 22 and cap 24 may be made of plastic or other substance, and may be taken from any conventional baby bottle available on the market. In addition, FIG. 6 shows better the solid construction of the shield 12 from the inside.

Figure 7:
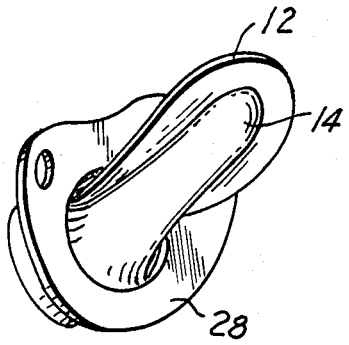
FIG. 7 is a perspective view of the present invention in its pacifier embodiment.
Figure 8:
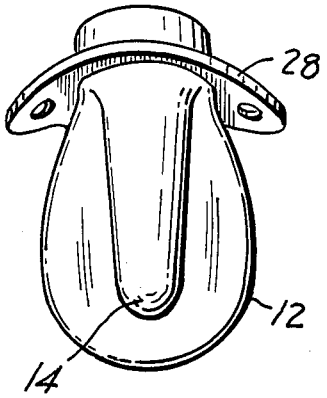
FIG. 8 is a side elevational view of the present invention in its pacifier embodiment.

Referring specifically to FIGS. 7 and 8, the shield 12 and incorporated nipple 14 are shown interconnected to a pacifier plug 28 which allows the infant to use the present invention as a pacifier.

In each of the above embodiments of the present invention the shield 12 and incorporated nipple 14 are preferably constructed of latex rubber which may be formed over a mold. The mold may be made in different standard sizes and may be custom made, if necessary, so that the formed shield 12 and nipple 14 properly fit into the mouth of the infant to seal the cleft palate.

The foregoing description of the preferred embodiments of the present invention are for illustrative purposes only and shall not be considered as limiting the scope of he present invention. Instead, the scope of the present invention shall be determined by the scope of the following claims and their equivalents.

I claim:

1. In connection with a child with a cleft palate and/or cleft lip, a device to allow the child to effectively suck by mouth, comprising:

a sealing means for sealably closing the cleft in the child's palate;

a nipple merged with and recessed under the sealing means; and the sealing means having a substantially solid, resilient elongated first portion substantially shaped in the form of the recessed nipple and a second portion in the form of a disk located on the periphery of said first portion and recessed nipple which substantially conforms to the periphery of the child's palate to substantially prevent the nipple from being pulled into the cleft palate and cleft lip.

2. The device in accordance with claim 1 further including means for interconnecting the nipple and sealing means to a container of liquid for conducting liquids from the container and through the nipple in response to the child sucking on the nipple.

* * * * *